US005198130A

United States Patent [19]

Schumacher

[11] Patent Number: 5,198,130

[45] Date of Patent: Mar. 30, 1993

[54] LUBRICANT COMPOSITIONS

[75] Inventor: Rolf Schumacher, Marly, Switzerland

[73] Assignee: Ciba-Geigy Corporation, Ardsley, N.Y.

[21] Appl. No.: 817,184

[22] Filed: Jan. 6, 1992

[30] Foreign Application Priority Data

Jan. 8, 1991 [CH] Switzerland ..... 33/91

[51] Int. Cl.[5] ..... C10M 133/28; C10M 137/04

[52] U.S. Cl. ..... 252/32.7 E; 252/50; 252/51.5 R

[58] Field of Search ..... 252/50, 21.51.5 R, 32.7 E

[56] References Cited

U.S. PATENT DOCUMENTS

| | | | |
|---|---|---|---|
| 4,110,349 | 8/1978 | Cohen | 260/346.74 |
| 4,692,258 | 9/1987 | Rasberger et al. | 252/50 |
| 5,073,278 | 12/1991 | Schumacher et al. | 252/47.5 |

FOREIGN PATENT DOCUMENTS

| | | |
|---|---|---|
| 271363 | 6/1988 | European Pat. Off. . |
| 356677 | 6/1990 | European Pat. Off. . |
| 406826 | 1/1991 | European Pat. Off. . |
| 60-28496 | 2/1985 | Japan . |
| 1425200 | 3/1986 | U.S.S.R. . |

OTHER PUBLICATIONS

Smalheer et al., "Lubricant Additives", 1967.

*Primary Examiner*—Ellen McAvoy
*Attorney, Agent, or Firm*—Luther A. R. Hall

[57] ABSTRACT

Lubricant compositions free of barium salt are described, which comprise

A) a lubricant,

B) at least one compound of the formula I

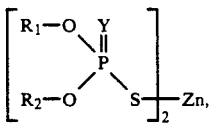

(I)

in which $R_1$ and $R_2$, independently of one another are $C_1$-$C_{20}$alkyl, $C_3$-$C_{18}$alkenyl, phenyl, phenyl substituted by $C_1$-$C_{20}$alkyl, phenyl-$C_1$-$C_4$alkyl, $C_2$-$C_{12}$hydroxyalkyl, $C_5$-$C_{12}$cycloalkyl, $C_5$-$C_{12}$cycloalkyl substituted by $C_1$-$C_4$alkyl, or naphthyl and Y represents O or S, and C) at least one compound of the formula II, III, or IV

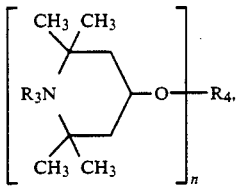

(II)

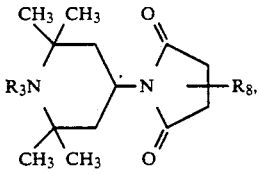

(III)

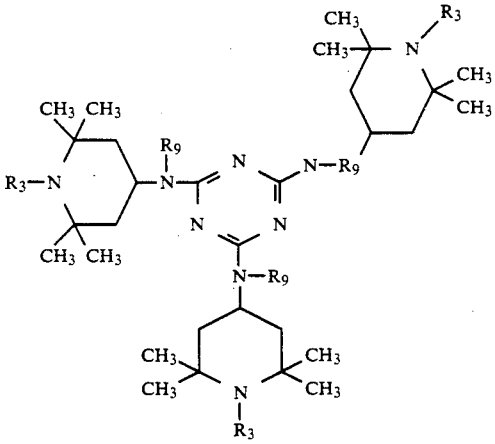

(IV)

in which n is a number from 1 to 4, $R_3$ is hydrogen, oxyl, hydroxyl, $C_1$-$C_{12}$alkyl, $C_3$-$C_8$alkenyl, $C_3$-$C_8$alkynyl, phenyl-$C_1$-$C_4$alkyl, $C_1$-$C_{18}$alkoxy, $C_5$-$C_8$cycloalkoxy, $C_7$-$C_9$phenylalkoxy, $C_2$-$C_8$alkanoyl, $C_3$-$C_5$alkenoyl, $C_2$-$C_{18}$alkanoyloxy, benzyloxy, glycidyl or a group —$CH_2CH(OH)$—Z in which Z is hydrogen, methyl or phenyl, and, if n is 1 $R_4$is hydrogen, $C_1$-$C_{18}$alkyl or $C_2$-$C_{18}$alkyl which is interrupted by one or more oxygen atoms, $C_3$-$C_8$alkenyl, cyanoethyl, benzyl, glycidyl, a monovalent radical of an aliphatic or cycloaliphatic, araliphatic or aromatic carboxyylic acid, carbamic acid or phosphorus-containing acid or a monovalent silyl radical, if n is 2 $R_4$ is $C_1$-$C_{12}$alkylene, $C_4$-$C_{12}$alkenylene, xylylene, a divalent radical of an aliphatic, cycloaliphatic, araliphatic or aromatic dicarboxylic acid, dicarbamic acid or a phosphorus-containing acid or a divalent silyl radical, if n is 3 $R_4$ is a trivalent radical of an aliphatic, cycloaliphatic or aromatic tricarboxylic acid, an aromatic tricarbamic acid or a phosphorus-containing acid or a trivalent silyl radical, and, if n is 4, $R_4$ is a tetravalent radical of an aliphatic, cycloaliphatic or aromatic tetracarboxylic acid, and $R_8$ is $C_1$-$C_{18}$alkyl or a polyisobutylene radical, and $R_9$ is $C_1$-$C_8$alkyl.

The compositions serve to improve the use properties of the corresponding lubricant and have in particular good resistance to oxidation at high temperatures.

13 Claims, No Drawings

LUBRICANT COMPOSITIONS

The present invention relates to lubricant compositions containing a combination of zinc dialkyl (di)thiophosphates and certain 2,2,6,6-tetramethylpiperidine derivatives.

Owing to their multifunctional mode of action as antiabrasives, anticorrosives and antioxidants, zinc dialkyl dithiophosphates (ZDTP) are among the most important lubricant additives (cf. Ullmanns Enzyklopädie der technischen Chemie (Ullmann's Encyclopaedia of Industrial Chemistry), 4th Edition, Vol. 20, p. 555, Weinheim 1984).

2,2,6,6-Tetramethylpiperidine derivatives were first used in the area of plastics additives as hindered amine light stabilisers. In the meantime, it has been found that they can also be effective in lubricants (for example JP-A-60/28 469, EP-A-0 356 677, EP-A-406 826). A lubricant composition containing the zinc salt/barium salt of a mixed alkyl/aryl dithiophosphate, a bis(dithioalkyl)phenol and 2,2,6,6-tetramethyl-4-oxopiperidine 1-oxyl has also been described (SU-A-1 425 200).

Surprisingly, it has now been found that mixtures of zinc dialkyl (di)thiophosphates with certain 2,2,6,6-tetramethylpiperidine derivatives (HALS) provide the lubricants with very good antioxidant properties and have in particular a favourable effect on the increase in viscosity resulting from thermal stress.

Accordingly, the present invention relates to a lubricant composition free of barium salt, which comprises A) a lubricant, B) at least one compound of the formula I

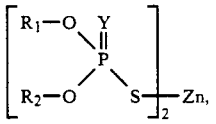

(I)

in which $R_1$ and $R_2$, independently of one another, are $C_1$–$C_{20}$alkyl, $C_3$–$C_{18}$alkenyl, phenyl, phenyl substituted by $C_1$–$C_{20}$alkyl, phenyl-$C_1$–$C_4$alkyl, $C_2$–$C_{12}$hydroxyalkyl, $C_5$–$C_{12}$cycloalkyl, $C_5$–$C_{12}$cycloalkyl substituted by $C_1$–$C_4$alkyl, or naphthyl and Y represents O or S, and C) at least one compound of the formula II, III, or IV

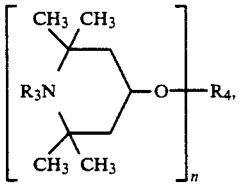

(II)

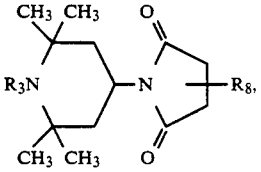

(III)

-continued

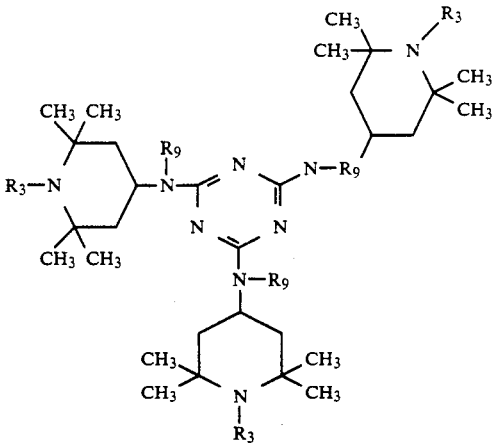

(IV)

in which n is a number from 1 to 4, $R_3$ is hydrogen, oxyl, hydroxyl, $C_1$–$C_{12}$alkyl, $C_3$–$C_8$alkenyl, $C_3$–$C_8$alkynyl, phenyl-$C_1$–$C_4$alkyl, $C_1$–$C_{18}$alkoxy, $C_5$–$C_8$cycloalkoxy, $C_7$–$C_9$phenylalkoxy, $C_2$–$C_8$alkanoyl, $C_3$–$C_5$alkenoyl, $C_2$–$C_{18}$alkanoyloxy, benzyloxy, glycidyl or a group —$CH_2CH(OH)$—Z, in which Z is hydrogen, methyl or phenyl, and, if n is 1 $R_4$ is hydrogen, $C_1$–$C_{18}$alkyl or $C_2$–$C_{18}$alkyl which is interrupted by one or more oxygen atoms, $C_3$–$C_8$alkenyl, cyanoethyl, benzyl, glycidyl, a monovalent radical of an aliphatic or cycloaliphatic, araliphatic or aromatic carboxylic acid, carbamic acid or phosphorus-containing acid or a monovalent silyl radical, if n is 2 $R_4$ is $C_1$–$C_{12}$alkylene, $C_4$–$C_{12}$alkenylene, xylylene, a divalent radical of an aliphatic, cycloaliphatic, araliphatic or aromatic dicarboxylic acid, dicarbamic acid or a phosphorus-containing acid or a divalent silyl radical, if n is 3 $R_4$ is a trivalent radical of an aliphatic, cycloaliphatic or aromatic tricarboxylic acid, an aromatic tricarbamic acid or a phosphorus-containing acid or a trivalent silyl radical, and, if n is 4, $R_4$ is a tetravalent radical of an aliphatic, cycloaliphatic or aromatic tetracarboxylic acid, and $R_8$ is $C_1$–$C_{18}$alkyl or a polyisobutylene radical, and $R_9$ is $C_1$–$C_8$alkyl.

$R_1$ and $R_2$ and $R_8$ as $C_1$–$C_{18}$($C_{20}$)alkyl can be straight-chain or branched and are, for example, methyl, ethyl, propyl, isopropyl, n-butyl, isobutyl, t-butyl, pentyl, isopentyl, hexyl, heptyl, 3-heptyl, octyl, 2-ethylhexyl, nonyl, decyl, undecyl, dodecyl, tridecyl, tetradecyl, pentadecyl, hexadecyl, heptadecyl, octadecyl, 2-ethylbutyl, 1-methylpentyl, 1,3-dimethylbutyl, 1,1,3,3-tetramethylbutyl, 1-methylhexyl, isoheptyl, 1-methylheptyl, 1,1,3-trimethylhexyl, 1-methylundecyl (or eicosyl). Examples of $R_9$ as $C_1$–$C_8$alkyl can be seen from the above list.

Examples of $R_1$ and $R_2$ as $C_3$–$C_{18}$alkenyl are radicals derived from the above alkyl radicals having 3 to 18 C atoms and containing one or more C=C double bonds. $C_3$–$C_8$Alkenyl is preferred, as described below for $R_3$ and $R_4$. Examples of $R_1$, $R_2$ and $R_3$ as phenyl-$C_1$–$C_4$alkyl are benzyl, phenethyl, 3-phenylpropyl, α-methylbenzyl or α,α-dimethylbenzyl. Benzyl is preferred. If $R_1$ and $R_2$ are phenyl substituted by $C_1$–$C_{20}$alkyl or $C_1$–$C_4$alkyl, examples of possible alkyl substituents are the abovementioned ones up to the appropriate number of C atoms. For example, 1–3, in particular 1 or 2, in particular 1, alkyl substituent(s) can be present therein. The total number of C atoms of all alkyl substituents in $R_1$ and $R_2$ is preferably 1 to 30, in particular 1 to 20.

Examples of $R_1$ and $R_2$ as $C_2$–$C_{12}$hydroxyalkyl are: 2-hydroxyethyl, 1,2-dihydroxyethyl, 2-hydroxypropyl, 2,3-dihydroxypropyl, 1,3-dihydroxypropyl, 3-hydroxypropyl, 4-hydroxybutyl, and other alkyl radicals substituted by one or more hydroxyl groups, as listed above and having 2–12 C atoms. 2-Hydroxyethyl is preferred.

Examples of $R_1$ and $R_2$ as $C_5$–$C_{12}$cycloalkyl include cyclopentyl, cyclohexyl, cycloheptyl, cyclooctyl, cyclodecyl and cyclododecyl. Cyclopentyl, cyclohexyl and cycloheptyl are preferred, and cyclohexyl is particularly preferred. Examples of $R_1$ and $R_2$ as $C_1$–$C_4$alkyl-substituted cycloalkyl (1–3, for example 1 or 2, alkyl groups being preferably present) are 2- or 4-methylcyclohexyl, dimethylcyclohexyl, trimethylcyclohexyl, and t-butylcyclohexyl.

Examples of $R_3$ and $R_4$ as $C_1$–$C_{12}$alkyl and $C_1$–$C_{18}$alkyl are the examples mentioned above for $R_1$ and $R_2$ up to a number of 12 and 18 C atoms respectively.

$R_3$ and $R_4$ as $C_{3-8}$alkenyl are straight-chain or branched, for example 1-propenyl, allyl, methallyl, 2-butenyl, 2-pentenyl, 2-hexenyl, 2-octenyl or 4-tert-butyl-2-butenyl.

$R_3$ as $C_{2-8}$alkanoyl has the meaning of radicals of the formula —CO—$C_{1-7}$alkyl, the abovementioned examples up to a number of 7 C atoms being possible for the alkyl radicals. Formyl, acetyl, propionyl, butyryl, octanoyl are preferred, and acetyl is particularly preferred.

$R_3$ as $C_3$–$C_5$alkenoyl has the meaning of radicals of the formula —CO—$C_{2-4}$alkenyl, the abovementioned examples up to a number of 4 C atoms being possible for the alkenyl radicals. Acryloyl is preferred.

$R_3$ as $C_1$–$C_{18}$alkoxy is —O—$C_1$–$C_{18}$alkyl; analogously, $R_3$ as $C_5$–$C_8$cycloalkoxy is —O—$C_{5-C8}$cycloalkyl, preferably cyclohexoxy. Examples of alkyl and cycloalkyl groups can be seen from the above list for $R_1$ and $R_2$.

Examples of $R_3$ as $C_7$–$C_{10}$phenylalkyl are benzyl, phenethyl, 3-phenylpropyl, α-methylbenzyl, or α,α-dimethylbenzyl. Benzyl is preferred.

$R_3$ as $C_7$–$C_9$phenylalkoxy is —O—phenyl—$C_1$–$C_3$alkyl. Examples of radicals bound to oxygen are the ones mentioned for phenyl-$C_1$–$C_4$alkyl up to a number of nine C atoms.

$R_3$ as $C_3$–$C_8$alkynyl is derived from the alkyl radicals having 3 to 8 C atoms in which 2 C atoms are connected by a triple bond and is preferably propargyl.

$R_3$ as phenyl-$C_1$–$C_4$alkyl is in particular phenethyl and especially benzyl.

$R_3$ as $C_2$–$C_{18}$alkanoyloxy is the radical of a $C_1$–$C_{18}$alkylcarboxylic acid—O—CO—$C_1$–$C_{17}$alkyl, containing, for example, the alkyl radicals mentioned above by way of example with the exception of octadecyl and eicosyl.

$R_4$ as the radical of an acid is esterified with the O atom in formula II, resulting, for example, in the groupings —O—CO—, —O—PO—O— and —O—PO(—O—)$_2$. Where these acid radicals are derived from carboxylic acids, aliphatic radicals have preferably 2–20 and cyclic radicals preferably 6–18 C atoms.

$R_4$ as a monovalent radical of a carboxylic acid, preferably a radical —CO—$R_6$, in which $R_6$ is $C_1$–$C_{20}$alkyl, $C_2$–$C_{18}$alkenyl, $C_5$–$C_7$cycloalkyl, $C_5$–$C_7$cycloalkyl which is substituted by $C_1$–$C_8$alkyl, phenyl, phenyl which is substituted by $C_1$–$C_4$alkyl or/and hydroxyl, is, for example, an acetic acid, caproic acid, stearic acid, acrylic acid, methacrylic acid, benzoic acid or β—(3,5-di-terr-butyl-4-hydroxyphenyl)propionic acid radical. $R_4$ as the monovalent radical of a phosphorus-containing acid is in particular —PO($OR_5$) or —PO($OR_5$)$_2$, in which $R_5$ can be, for example, hydrogen, $C_1$–$C_{12}$alkyl, phenyl or benzyl, $R_4$ as a monovalent silyl radical is preferably —Si($CH_3$)$_3$ or —Si($CH_3$)$_2$—Si($CH_3$)$_3$. Examples of $R_4$ as $C_2$–$C_{12}$alkylene are ethylene, propylene, 2,2-dimethylpropylene, tetramethylene, hexamethylene, octamethylene, decamethylene or dodecamethylene.

Examples of $R_4$ as $C_4$–$C_{12}$alkenylene are radicals derived from the above groups and having a C=C double bond, in particular 2-butenylene, 2-pentenylene or 3-hexenylene.

$R_4$ as a divalent radical of a phosphorus-containing acid is preferably —PO— or —PO($OR_5$). $R_4$ as a divalent silyl radical is in particular —Si($CH_3$)$_2$— oder —Si($CH_3$)$_2$—Si($CH_3$)$_2$—. $R_4$ as a divalent radical of a dicarboxylic acid, preferably a radical —CO—$R_7$—CO—, in which $R_7$ is $C_1$–$C_{18}$alkylene, $C_5$–$C_{12}$cycloalkylene, $C_2$–$C_{18}$(cyclo)alkenylene, $C_5$–$C_{12}$cycloalkenylene, $C_2$–$C_8$alkylene substituted by phenyl or alkyl-or/and hydroxyl-substituted phenyl, or phenylene, is for example a malonic acid, succinic acid, glutaric acid, adipic acid, suberic acid, sebacic acid, maleic acid, itaconic acid, phthalic acid, dibutylmalonic acid, dibenzylmalonic acid, butyl-(3,5-di-tert-butyl-4-hydroxybenzyl)malonic acid or bicycloheptenedicarboxylic acid radical.

Examples of $R_4$ as a divalent radical of a dicarbamic acid are a hexamethylenedicarbamic acid or 2,4-toluylenedicarbamic acid radical.

Examples of $R_4$ as a trivalent radical of a tricarboxylic acid are a trimellitic acid, citric acid or nitrilotriacetic acid radical.

Examples of $R_4$ as a tetravalent radical of a tetracarboxylic acid are the tetravalent radical of butane-1,2,3,4-tetracarboxylic acid or of pyromellitic acid. $R_4$ is particularly preferably the radical of a monovalent or divalent dicarboxylic acid, in particular of the formula —$COR_6$ or —CO—$R_7$—CO—, in which $R_6$ is preferably $C_6$–$C_{20}$alkyl and $R_7$ is preferably $C_2$–$C_{12}$alkylene.

Advantageously, $R_4$ is other than hydrogen. $R_4$ as alkyl or alkylene has in particular at least 6 C atoms.

Preference is given to compounds of the formula II in which $R_3$ is hydrogen or methyl, n is 2 and $R_4$ is the diacyl radical of an aliphatic dicarboxylic acid having 3–12 C atoms.

$R_8$ a polyisobutylene radical has preferably a number-average molecular weight of around 700 to around 3000. Radicals of this type are described in more detail in U.S. Pat. No. 4,110,349 and EP-A-0 271 363.

Examples of polyalkylpiperidine compounds of the formula II are the following compounds:

1) 4-Hydroxy-2,2,6,6-tetramethylpiperidine
2) 1-Allyl-4-hydroxy-2,2,6,6-tetramethylpiperidine
3) 1-Benzyl-4-hydroxy-2,2,6,6-tetramethylpiperidine
4) 1-(4-tert-Butyl-2-butenyl)-4-hydroxy-2,2,6,6-tetramethylpiperidine
5) 4-Stearoloxy-2,2,6,6-tetramethylpiperidine
6) 1-Ethyl-4-salicyloyloxy-2,2,6,6-tetramethylpiperidine
7) 4-Methacryloyloxy-1,2,2,6,6-pentamethylpiperidine
8) 1,2,2,6,6-Pentamethylpiperidin-4-yl β-(3,5-di-tert-butyl-4-hydroxyphenyl)propionate
9) Di(1-benzyl-2,2,6,6-tetramethylpiperidin-4-yl)maleate
10) Di(2,2,6,6-tetramethylpiperidin-4-yl) succinate
11) Di(2,2,6,6-tetramethylpiperidin-4-yl) glutarate
12) Di(2,2,6,6-tetramethylpiperidin-4-yl adipate 13) Di(2,2,6,6-tetramethylpiperidin-4-yl) sebacate
14) Di(1,2,2,6,6-pentamethylpiperidin-4-yl) sebacate
15) Di(1,2,3,6-tetramethyl-2,6-diethyl-piperidin-4-yl) sebacate
16) Di(1-allyl-2,2,6,6-tetramethylpiperidin-4-yl) phthalate
17) 1-Hydroxy-4-β-cyanoethyloxy-2,2,6,6-tetramethylpiperidine
18) 1-Acetyl-2,2,6,6-tetramethylpiperidin-4-yl acetate
19) Tri(2,2,6,6-tetramethylpiperidin-4-yl) trimellitate
20) 1-Acryloyl-4-benzyloxy-2,2,6,6-tetramethylpiperidine
21) Di(2,2,6,6-tetramethylpiperidin-4-yl) diethylmalonate
22) Di(1,2,2,6,6-pentamethylpiperidin-4-yl) dibutylmalonate
23) Di(1,2,2,6,6-pentamethylpiperidin-4-yl)butyl-(3,5-di-tert-butyl-4-hydroxybenzyl) malonate
24) Di(1-octyloxy-2,2,6,6-tetramethylpiperidin-4-yl) sebacate
25) Di(1-cyclohexyloxy-2,2,6,6-tetramethylpiperidin-4-yl) sebacate
26) Hexane-1',6'-bis(4-carbamoyloxy-1-n-butyl-2,2,6,6-tetramethylpiperidine)
27) Toluene-2',4'-bis(4-carbamoyloxy-1-n-propyl-2,2,6,6-tetramethylpiperidine)
28) Dimethylbis(2,2,6,6-tetramethylpiperidin-4-oxy)silane
29) Phenyltris(2,2,6,6-tetramethylpiperidin-4-oxy)silane
30) Tris(1-propyl-2,2,6,6-tetramethylpiperidin-4-yl) phosphite
31) Tris(1-propyl-2,2,6,6-tetramethylpiperidin-4-yl) phosphate
32) Bis(1,2,2,6,6-pentamethylpiperidin-4-yl)phosphonate
33) 4-Hydroxy-1,2,2,6,6-pentamethylpiperidine
34) 4-Hydroxy-N-hydroxyethyl-2,2,6,6-tetramethylpiperidine
35) 4-Hydroxy-N-(2-hydroxypropyl)-2,2,6,6-tetramethylpiperidine
36) 1-Glycidyl-4-hydroxy-2,2,6,6-tetramethylpiperidine In formulae II, III and IV, $R_3$ is preferably hydrogen or methyl.

Advantageous compositions are those containing as component B) at least one compound of the formula I in which n is 1 or 2 and, if n is $R_4$ is $C_1$–$C_{18}$alkyl or a radical of an aliphatic carboxylic acid having 2 to 18 C atoms, of a cycloaliphatic carboxylic acid having 7 to 15 C atoms or of an aromatic carboxylic acid having 7 to 15 C atoms, if n is 2, $R_4$ is $C_1$–$C_{12}$alkylene or a radical of an aliphatic dicarboxylic acid having 2 to 18 C atoms, of a cycloaliphatic or aromatic dicarboxylic acid having 8–14 C atoms or of an aliphatic, cycloaliphatic or aromatic dicarbamic acid having 8–14 C atoms.

Preference is given to compositions in which $R_3$ is hydrogen, $C_1$–$C_4$alkyl, phenyl-$C_1$–$C_4$alkyl, $C_1$–$C_{12}$alkoxy, $C_2$–$C_8$alkanoyl or $C_3$–$C_5$alkenoyl, furthermore to compositions in which $R_1$ and $R_2$, independently of one another, are $C_4$–$C_{18}$alkyl, phenyl, phenyl substituted by $C_1$–$C_{12}$alkyl, benzyl, 2-hydroxyethyl, cyclohexyl or naphthyl.

Particular preference is given to compositions in which $R_3$ is H, $C_1$–$C_4$alkyl, allyl, benzyl, acetyl or acryloyl.

Very particular preference is given compositions in which component C has the formula

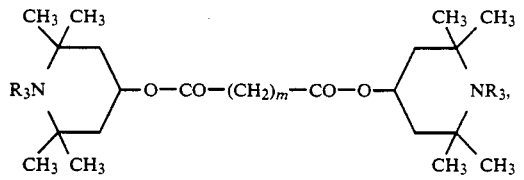

in which m adopts values from 1 to 12 and $R_3$ is hydrogen or $C_1$–$C_4$alkyl, likewise to those in which component C has the formula IV, in which $R_3$ is hydrogen, and furthermore to those in which component C has the formula III, in which $R_3$ is hydrogen.

It is also possible to add further antioxidants to the compositions according to the invention, for example those from the group of antiamine and oxidants, such as the unsubstituted or alkyl-substituted diphenylamines, for example a mixture of those diphenylamines in which a) diphenylamine,
b) 4-tert-butyldiphenylamine,
c) compounds from the group comprising
  i) 4-tert-octyldiphenylamine,
  ii) 4,4'-di-tert-butyldiphenylamine,
  iii) 2,4,4'-tris(tert-butyl)diphenylamine,
d) compounds from the group comprising
  i) 4-tert-butyl-4'-tert-octyldiphenylamine,
  ii) o,o',m,m', or p,p'-di-tert-octyldiphenylamine,
  iii) 2,4-di-tert-butyl-4'-tert-octyldiphenylamine,
e) compounds from the group comprising
  i) 4,4'-di-tert-octyldiphenylamine,
  ii) 2,4-di-tert-octyl-4'-tert-butyldiphenylamine are present and advantageously no more than 5% of component a), 8 to 15% of b), 24 to 32% of c), 23 to 34% of d) and 21 to 34% of e) are present.

The lubricants contained in the compositions according to the invention may decompose more or less easily upon exposure to heat, light and radiation, mechanical stress (in particular caused by shearing forces) and chemical reagents (in particular oxidation by atmospheric oxygen).

Compounds which are suitable as protection against these influences, in particular against oxidation, are components B) and C), which should be present in the compositions according to the invention advantageously in a total amount of 0.01 to 10, for example 0.05 to 5, preferably 0.05 to 3, but in particular of 0.1 to 2% by weight. The weight percentages given refer to the entire amount of these compounds. The basis of calculation is the total weight of the lubricant without components B) and C).

The B:C weight ratio is preferably 10:1 to 1:2, advantageously 6:1 to 1:1, in particular 5:1 to 2:1.

Suitable lubricants are based, for example, on mineral or synthetic oils or mixtures thereof. The lubricants are known to one skilled in the art and described in the relevant technical literature, for example in Dieter Klamann "Schmierstoffe and verwandte Produkte" (Lubricants and Related Products), (Verlag Chemie, Weinheim, 1982), in Schewe-Kobek, "Das Schmiermittel-Taschenbuch" (Handbook of Lubricants) (Dr. Alfred Hüthig-Verlag, Heidelberg, 1974) and in "Ullmanns Enzyklopädie der technischen Chemie" (Ullmann's Encyclopaedia of Industrial Chemistry), vol. 13, pages 85–94 (Verlag Chemie, Weinheim, 1977).

The lubricants are in particular oils and fats, for example based on a mineral oil. Oils are preferred.

A further group of lubricants which may be used are vegetable or animal oils, fats, tallows and waxes or mixtures thereof with one another or mixtures with the mineral or synthetic oils mentioned. Examples of vegetable and animal oils, fats, tallows and waxes are palm kernel oil, palm oil, olive oil, beetroot oil, rape oil, linseed oil, groundnut oil, soya bean oil, cotton oil, sunflower oil, pumpkin seed oil, coconut oil, corn oil, castor oil, walnut oil and mixtures thereof, fish oils, tallows from slaughtered animals, such as beef tallow, neatsfoot oil and bone oil and modified, epoxidised and sulfoxidised forms thereof, for example epoxidised soya bean oil.

The mineral oils are based in particular on hydrocarbon compounds.

Examples of synthetic lubricants include lubricants based on aliphatic or aromatic carboxylic esters, polymeric esters, polyalkylene oxides, phosphoric esters, poly-α-olefins or silicones, diesters of a dibasic acid with a monohydric alcohol, for example dioctyl sebacate or dinonyl adipate, triesters of trimethylolpropane with a monobasic acid or a mixture of such acids, such as trimethylolpropane tripelargonate, trimethylolpropane tricaprylate or mixtures thereof, tetraesters of pentaerythritol with a monobasic acid or with a mixture of such acids, for example pentaerythritol tetracaprylate, or complex esters of monobasic and dibasic acids with polyhydric alcohols, for example complex esters of trimethylolpropane with caprylic and sebacic acid or a mixture thereof. In addition to mineral oils, examples of particularly suitable lubricants are poly-α-olefins, lubricants based on esters, phosphates, glycols, polyglycols and polyalkylene glycols, and their mixtures with water.

Lubricant compositions acco-ding to the invention are used, for example, in combustion engines, for example in automobiles. Of these, preferred components A) are those lubricants of mineral or/and synthetic origin which are suitable for use as motor oils in combustion engines, for example in those having external ignition (internal combustion engines) or having self-ignition (diesel engines). Accordingly, the invention also relates to the use of the compositions according to the invention as motor oils.

The present invention also relates to a process for improving the use properties of lubricants which contain no barium salts and to which at least one compound of the formula I and at least one compound of the formulae II, III and IV are added.

The lubricants according to the invention can additionally contain other additives, which are added in order to improve the basic properties even further; these include: further antioxidants, metal passivators, rust inhibitors, viscosity index improvers, pour-point depressants, dispersants, detergents, further high-pressure additives and wear-resistant additives. These other additives are preferably not barium salts.

Examples of further additives of this type are listed below:

Examples of Phenolic Antioxidants

1. Alkylated monophenols: 2,6-di-tert-butyl-4-methylphenol, 2,6-di-tert-butylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-iso-butylphenol, 2,6-di-cyclopentyl-4-methylphenol, 2-(α-methylcyclohexyl)-4,6-dimethylphenol, 2,6-di-octadecyl-4-methylphenol, 2,4,6-tri-cyclohexylphenol, 2,6-di-tert-4-methoxymethylphenol, o-tert-butylphenol.

2. Alkylated hydroquinones: 2,6-di-tert-butyl-4-methoxyphenol, 2,5-di-tert-butyl-hydroquinone, 2,5-di-tert-amyl-hydroquinone, 2,6-diphenyl-4-octadecyloxyphenol.

3. Hydroxylated thiodiphenyl ethers: 2,2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol).

4. Alkylidene-bisphenols: 2,2'-methylenebis(6-tert-butyl-4-methylphenol), 2,2'-methylenebis(6-tert-butyl-4-ethylphenol), 2,2'-methylenebis[4-methyl-6-(α-methylcyclohexyl)phenol], 2,2'-methylenebis(4-methyl-6-cyclohexylphenol), 2,2'-methylenebis(6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4- or -5-isobutylphenol), 2,2'-methylenebis[6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-di(3-tert-butyl-5-methyl-2-hydroxybenzyl)-4-methylphenol, 1,1,3-tris(5-tert-butyl-4-hydroxy-2-methylphenyl)-3-n-dodecylmercaptobutane, ethylene glycol di[3,3-bis-(3'-tert-butyl-4'-hydroxyphenyl)butyrate], di(3-tert-butyl-4-hydroxy-5-methylphenyl)dicyclopentadiene, di[2-(3'-tert-butyl-2'-hydroxy-5'-methylbenzyl)-6-tert-butyl-4-methylphenyl] terephthalate.

5. Benzyl compounds: 1,3,5-tri(3,5-di-tert-butyl-4-hydroxybenzyl)2,4,6-trimethylbenzene, di(3,5-di-tert-butyl-4-hydroxybenzyl) sulfide, isotridecyl 3,5-di-tert-butyl-4-hydroxybenzylmercaptoacetate, isooctyl 3,5-di-tert-butyl-4-hydroxybenzyl-mercaptoacetate, bis(4-tert-butyl-3-hydroxy-2,6-dimethylbenzyl) dithioterephthalate, 1,3,5-tris(3,5-di-tert-butyl-4-hydroxybenzyl) isocyanurate, 1,3,5-tris(4-tert-butyl-3-hydroxy-2,6-dimethylbenzyl) isocyanurate, dioctadecyl 3,5-di-tert-butyl-4-hydroxybenzylphosphonate, calcium monoethyl 3,5-di-tert-butyl-4-hydroxybenzylphosphonate.

6. Acylaminophenols: 4-hydroxylauranilide, 4-hydroxystearanilide, 2,4-bis(octylmercapto)-6-(3,5-di-tert-butyl-4-hydroxyanilino)-s-triazine, octyl N-(3,5-di-tert-butyl-4-hydroxyphenyl)carbamate.

7. Esters of β-(3,5-di-tert-butyl-4-hydroxyphenyl)-propionic acid with monohydric or polyhydric alcohols, for example, with methanol, isooctanol, diethylene glycol, octadecanol, triethylene glycol, 1,6-hexanediol, pentaerythritol, neopentyl glycol, trishydroxyethylisocyanurate, thiodiethylene glycol, bishydroxyethyl oxalamide.

8. esters of β-(5-tert-butyl-4-hydroxy-3-methylphenyl)propionic acid with monohydric or polyhydric alcohols, for example, with methanol, diethylene glycol, octadecanol, triethylene glycol, 1,6-hexanediol, pentaerythritol, neopentyl glycol, trishydroxyethylisocyanurate, thiodiethylene glycol, dihydroxyethyl oxalamide.

9. Amides of β-(3,5-di-tert-butyl-4-hydroxyphenyl)-propionic acid for example N,N'-di(3,5-di-tert-butyl-4-hydroxyphenylpropionyl)hexamethylenediamine, N,N'-di(3,5-di-tert-butyl-4-hydroxyphenylpropionyl)-trimethylenediamine, N,N'-di(3,5-di-tert-butyl-4-hydroxyphenylpropionyl)hydrazine.

Examples of Amine Antioxidants

N,N'-diisopropyl-p-phenylenediamine, N,N'-di-sec-butyl-p-phenylenediamine, N,N'-bis(1,4-dimethylpentyl)-p-phenylenediamine, N,N-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-di(2-naphthyl)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfonamido)-diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, di-(4-methoxyphenyl)amine, 2,6-di-tert-butyl-4-dimethylaminomethylphenol, 2,4'-diaminodiphenylmethane, 4,4'-diaminodiphenylmethane, N,N,N',N'-tetramethyl-4,4'-diaminodiphenylmethane, 1,2-di-[(2-methylphenyl)amino]ethane, 1,2-di(-phenylamino)propane, (o-tolyl)biguanide, di-[4-(1',3'-dimethylbutyl)phenyl]amine, tert-octylated N-phenyl-1-naphthylamine, mixture of mono- and dialkylated tert-butyl- and tert-octyldiphenylamines, 2,3-dihydro-3,3-dimethyl-4H-1,4-benzothiazine, phenothiazine, N-allylphenothiazine.

Examples of Further Antioxidants

Aliphatic or aromatic phosphites, esters of thiodipropionic acid or thiodiacetic acid, or salts of dithiocarbamic or dithiophosphoric acid, 2,2,12,12-tetramethyl-5,9-dihydroxy-3,7,11-trithiatridecane and 2,2,15,15-tetramethyl-5,12-dihydroxy-3,7,10,14-tetrathiahexadecane.

Examples of Metal Deactivators, for Example for Copper, Are

Triazoles, benzotriazoles and derivatives thereof, tolutriazoles and derivatives thereof, 2-mercaptobenzothiazole, 2-mercaptobenzotriazole, 2,5-dimercaptobenzotriazole, 2,5-dimercaptobenzothiadiazole, 5,5'-methylenebis(benzotriazole), 4,5,6,7-tetrahydrobenzotriazole, salicylidenepropylenediamine, salicylaminoguanidine and salts thereof, 1-[N,N-bis(2-ethylhexyl)aminomethyl]-5(6)-methyl-1H-benzotriazole, 1-(1-cyclohexyloxybutyl-5(6)-methyl-1H-triazole, 1-[N,N-bis(2-ethylhexyl)aminomethyl]-1H-1,2,4-triazole.

Examples of Rust Inhibitors Are a) Organic acids, the esters, metal salts and anhydrides thereof, e.g.: N-oleoylsarcosine, sorbitan monooleate, lead naphthenate, alkenylsuccinic anhydrides, e.g. dodecenylsuccinic anhydride, alkenylsuccinic monoesters and monoamides, 4-nonylphenoxyacetic acid, 2-(2-carboxyethyl)-1-dodecyl-3-methylglycerol and salts thereof, in particular sodium salts and triethanolamine salts.

b) Nitrogen-containing compounds, e.g.:

i. Primary, secondary or tertiary aliphatic or cycloaliphatic amines and amine salts of organic and inorganic acids, for example oil-soluble alkylammonium carboxylates, furthermore 1-[N,N-bis-(2-hydroxyethyl)amino]-3-(4-nonylphenoxy)propan-2-ol.

ii. Heterocyclic compounds, e.g.: substituted imidazolines and oxazolines. c) Phosphorus-containing compounds, e.g.: amine salts of phosphoric acid partial esters or phosphonic acid partial esters.

d) Sulfur-containing compounds, e.g.: calcium petroleum sulfonates.

Examples of Viscosity Index Improvers Are

Polyacrylates, polymethacrylates, vinylpyrrolidone/methacrylate copolymers, polyvinylpyrrolidones, polybutenes, olefin copolymers, styrene/acrylate copolymers, polyethers.

Examples of Pour-Point Depressants Are

Polymethacrylate, alkylated naphthalene derivatives.

Examples of Dispersants/Surfactants Are

Polybutenylsuccinamides or -imides, polybutenylphosphonic acid derivatives, basic magnesium sulfonates and phenolates and calcium sulfonates and phenolates.

Examples of Anti-Wear Additives Are

Compounds which contain sulfur and/or phosphorus and/or halogen, such as sulfurised vegetable oils, tritolyl phosphate, chlorinated paraffins, alkyl di- and trisulfides and aryl di- and trisulfides, triphenyl phosphorothionates, diethanolaminomethyltolyltriazole, di(2-ethylhexyl)aminomethyltolyltriazole, ethyl 3-[(bis-isopropyloxyphosphinothioyl)thio]propionate, mixtures of alkylphenylphosphorothioates, triphenyl thiophosphate, dodecylamino salt of 3-hydroxy-1,3-thiaphosphetane 3-oxide, 5,5,5-tris[2-acetatoisooctyl] trithiophosphate, 1-[N,N-bis(2-ethylhexyl)aminomethyl-2-mercapto-1H-1,3-benzothiazole.

Although the compositions according to the invention can additionally contain additives from the above-mentioned groups, in another embodiment those are considered advantageous which a) do not contain any aromatic amine (such as described in EP-A-0 356 677) or/and b) do not contain any sterically hindered phenol (such as described in EP-A-406 826).

The preparation of the zinc dialkyl (di)thiophosphates of the formula I, some of which are commercially available, is known per se and can be carried out, for example, according to Houben Weyl "Methoden der organischen Chemie" (Methods of Organic Chemistry), G. Thieme Verlag Stuttgart 1964, pages 53–77, 143–210, 226–274, 299–376 and 587–748.

Some of the compounds from the series of cyclic, sterically hindered amines of the formulae II, III and IV are also commercially available, and their preparation is described in the relevant literature, for example in DE-A-1 929 928 and DE-A-2 204 659.

The exemplary embodiments which follow illustrate the invention in more detail without, however, limiting it. Unless stated otherwise, parts and percentages given are by weight.

EXAMPLES 1–3

The additives listed in Table 1 are admixed in the amounts listed there to a mineral oil (type RL 136).

TABLE 1

| Example No. | Formulation | |
|---|---|---|
| | ZDPT Component | HALS Component |
| Example 1 | a) 0.8% of ZDPT 1 | 0.2% of HALS 1 |
| | b) 0.6% of ZDPT 1 | 0.4% of HALS 1 |
| Example 2 | 0.8% of ZDPT 3 | 0.2% of HALS 1 |
| Example 3 | a) 0.8% of ZDPT 2 | 0.2% of HALS 1 |
| | b) 0.7% of ZDPT 2 | 0.3% of HALS 1 |

Notes:
ZDTP 1:

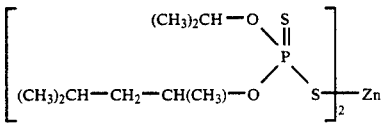

ZDTP 2:

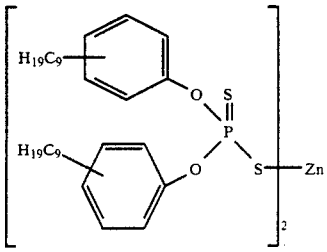

ZDTP 3:

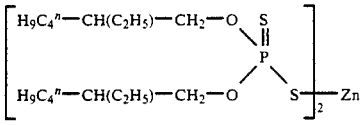

HALS 1:

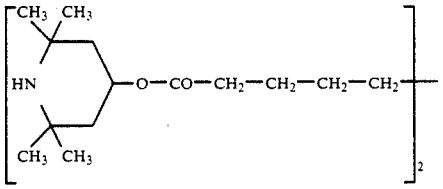

EXAMPLE 4

Thermal Stabilisation of a Synthetic Oil

Thermal ageing of the formulations is carried out in a pressure differential calorimeter (pressure differential scanning calorimetry, PDSC).

The measurements were carried out using an HP differential calorimeter TA-4000 from Mettler-Toledo. The TA processor TC 11 is coupled with an IBM PC (PS/2 70). For analysis of the results, a Mettler Graph Ware TA 72.2/.5 was used. PDSC measurements make it possible to measure the heat given off during oxidation reliably and rapidly. The pressure cell (Tor System) comprises a heating block and a ceramic sensor suitable for measurements in the presence of corrosive gases. Three drops of oil are poured into the sample dish (aluminium). The reference dish remains empty. All measurements are carried out in air +400 ppm of $NO_x$. The pressure is 8 bar. A "low reference oil" for motor oils (RL 136) serves as base oil. In order to enhance the susceptibility to oxidation, 1% of 1-decene is added to this oil. The heat given off dQ/dt is determined as a function of time. In thermal ageing, the concentration of the ageing stabilisers added decreases continuously. As soon as a critical additive concentration is reached, the heat given off dQ/dt [mW] increases. The time which elapses until this increase takes place is called induction time or onset. Accordingly, long induction times indicate a high ageing stability of the oils.

The values of the formulations tested by PDSC and prepared according to Examples 1-3 and, for comparison, those of formulations containing no compound of the formula II can be seen from Table 2.

TABLE 2

| Formulation | | |
|---|---|---|
| ZDTP Component | HALS Component | Induction time [min] |
| 1% of ZDTP 1 | | 26.5 |
| 0.8% of ZDTP 1 | 0.2% of HALS 1 | 28.5 |
| 0.6% of ZDTP 1 | 0.4% of HALS 1 | 32.6 |
| 1% of ZDTP 3 | | 25.9 |
| 0.8% of ZDTP 3 | 0.2% of HALS 1 | 27.5 |
| 1% of ZDTP 2 | | 32.6 |
| 0.8% of ZDTP 2 | 0.2% of HALS 1 | 52.1 |
| 0.7% of ZDTP 2 | 0.3% of HALS 1 | 33.9 |

The longer induction times show that replacement of a portion of ZDTP by the HALS component significantly increases the oxidation stability of the lubricant.

Using the same test method as described above, it is possible to determine a further measure of the stabilising effect: the time until the peak maximum of the dQ/dT curve obtained is a measure of the ability of the additive to retard overall oxidation. Long times denote good oxidation inhibition. Table 3 below shows the values obtained for three further combinations according to the invention. It can be seen that they clearly increase the oxidation stability of the lubricant.

TABLE 3

| Formulation | | |
|---|---|---|
| ZDPT Component | HALS Component | Time until reaching the peak maximum [min] |
| 1% of ZDPT 1 | | 48.4 |
| 0.8% of ZDPT 1 | 0.2% of HALS 2 | 62.9 |
| 0.8% of ZDPT 1 | 0.2% of HALS 3 | 59.5 |

TABLE 3-continued

| Formulation | | |
|---|---|---|
| ZDPT Component | HALS Component | Time until reaching the peak maximum [min] |
| 0.8% of ZDPT 1 | 0.2% of HALS 4 | 69.1 |

Notes:
HALS 2:

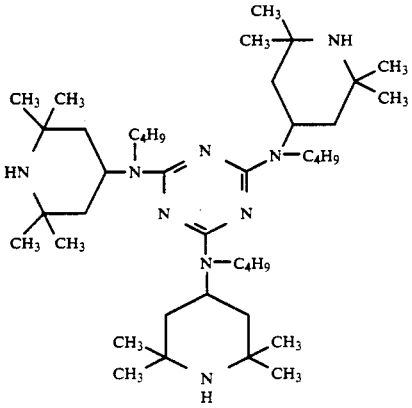

HALS 3:

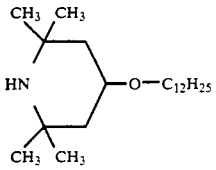

HALS 4:

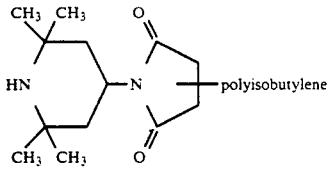

[Reaction product from 2,2,6,6-tetramethyl-4-aminopiperidine with polyisobutylenesuccinic anhydride (PIBSA, from Exxon, No. ECA 9605 )]

What is claimed is:

1. A composition free of barium salt and comprising

A) a lubricant,

B) at least one compound of the formula I

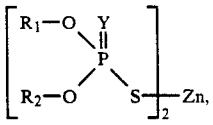

(I)

in which $R_1$ and $R_2$, independently of one another, are $C_1$–$C_{20}$alkyl, $C_3$–$C_{18}$alkenyl, phenyl, phenyl substituted by $C_1$–$C_{20}$alkyl, phenyl-$C_1$–$C_4$alkyl, $C_2$–$C_{12}$hydroxyalkyl, $C_5$–$C_{12}$cycloalkyl, $C_5$–$C_{12}$cycloalkyl substituted by $C_1$–$C_4$alkyl, or naphthyl and Y represents O or S, and C) at least one compound of the formula II, III, or IV

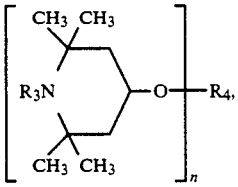

(II)

-continued

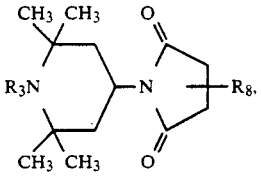

(III)

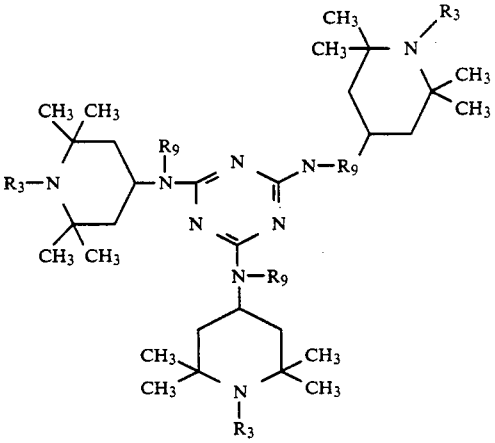

(IV)

in which n is a number from 1 to 4, $R_3$ is hydrogen, oxyl, hydroxyl, $C_1$–$C_{12}$alkyl, $C_3$–$C_8$alkenyl, $C_3$–$C_8$alkynyl, phenyl-$C_1$–$C_4$alkyl, $C_1$–$C_{18}$alkoxy, $C_5$–$C_8$cycloalkoxy, $C_7$–$C_9$phenylalkoxy, $C_2$–$C_8$alkanoyl, $C_3$–$C_5$alkenoyl, $C_2$–$C_{18}$alkanoyloxy, benzyloxy, glycidyl or a group —$CH_2CH(OH)$—Z, in which Z is hydrogen, methyl or phenyl, and, if n is 1 $R_4$ is hydrogen, $C_1$–$C_{18}$alkyl or $C_2$–$C_{18}$alkyl which is interrupted by one or more oxygen atoms, $C_3$–$C_8$alkenyl, cyanoethyl, benzyl, glycidyl, a monovalent radical of an aliphatic or cycloaliphatic, araliphatic or aromatic carboxylic acid, carbamic acid or phosphorus-containing acid or a monovalent silyl radical, if n is 2 $R_4$ is $C_1$–$C_{12}$alkylene, $C_4$–$C_{12}$alkenylene, xylylene, a divalent radical of an aliphatic, cycloaliphatic, araliphatic or aromatic dicarboxylic acid, dicarbamic acid or a phosphorus-containing acid or a divalent silyl radical, if n is 3 $R_4$ is a trivalent radical of an aliphatic, cycloaliphatic or aromatic tricarboxylic acid, an aromatic tricarbamic acid or a phosphorus-containing acid or a trivalent silyl radical, and, if n is 4, $R_4$ is a tetravalent radical of an aliphatic, cycloaliphatic or aromatic tetracarboxylic acid, and $R_8$ is $C_1$–$C_{18}$alkyl or a polyisobutylene radical, and $R_9$ is $C_1$–$C_8$alkyl, subject to the proviso that the composition does not contain any aromatic amine.

2. A composition according to claim 1, in which n is 1 or 2 and, if n is 1, $R_4$ is $C_1$–$C_{18}$alkyl or a radical of an aliphatic carboxylic acid having 2 to 18 C atoms, of a cycloaliphatic carboxylic acid having 7 to 15 C atoms or of an aromatic carboxylic acid having 7 to 15 C atoms, if n is 2, $R_4$ is $C_1$–$C_{12}$alkylene or a radical of an aliphatic dicarboxylic acid having 2 to 18 C atoms, of a cycloaliphatic or aromatic dicarboxylic acid having 8–14 C atoms or of an aliphatic, cycloaliphatic or aromatic dicarbamic acid having 8–14 C atoms.

3. A composition according to claim 1, in which $R_3$ is hydrogen, $C_1$–$C_4$alkyl, phenyl-$C_1$–$C_4$alkyl, $C_1$–$C_{12}$alkoxy, $C_2$–$C_8$alkanoyl, or $C_3$–$C_5$alkenoyl.

4. A composition according to claim 1, in which $R_3$ is H, $C_1$–$C_4$alkyl, allyl, benzyl, acetyl or acryloyl.

5. A composition according to claim 1, in which component C has the formula,

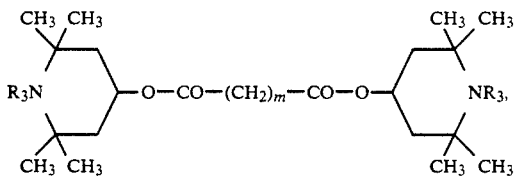

in which m adopts values from 1 to 12 and $R_3$ is hydrogen or $C_1$–$C_4$alkyl.

6. A composition according to claim 1, in which componet C has the formula IV, in which $R_3$ is hydrogen and $R_9$ is n-butyl.

7. A composition according to claim 1, in which component C has the formula III, in which $R_3$ is hydrogen.

8. A composition according to claim 1, in which $R_1$ and $R_2$, independently of one another, are $C_4$–$C_{18}$alkyl, phenyl, phenyl substituted by $C_1$–$C_{12}$alkyl, benzyl, 2-hydroxyethyl, cyclohexyl or naphthyl.

9. A composition according to claim 1, in which Y represents sulfur.

10. A composition according to claim 1, in which components B and C together are present in an amount of 0.01 to 10 per cent by weight, relative to A).

11. A composition according to claim 1, in which the B:C weight ratio is 6:1 to 1:1.

12. A composition according to claim 1, which additionally contains at least one further antioxidant.

13. A process for improving the use properties lubricants, which contain no barium salts and to which at least one compound of the formula I and at least one compound of the formulae II, III or IV according to claim 1 are added.

* * * * *